United States Patent [19]

Gino

[11] Patent Number: 4,466,229

[45] Date of Patent: Aug. 21, 1984

[54] PROCESS AND MACHINE FOR AUTOMATICALLY PACKING INDIVIDUAL DRINKING STRAWS, OR SIMILARLY SHAPED ARTICLES, IN WELDABLE FILMS

[76] Inventor: Donati Gino, Via Carpignola, 64, Cattolica (FO), Italy

[21] Appl. No.: 322,429

[22] Filed: Nov. 18, 1981

[30] Foreign Application Priority Data

Nov. 27, 1980 [IT] Italy ..... 648 A/80

[51] Int. Cl.[3] ..... B65B 13/04; B65B 27/10; B65H 9/08

[52] U.S. Cl. ..... 53/559; 53/591; 221/201; 221/202; 221/205; 221/251

[58] Field of Search ..... 53/453, 454, 559, 560, 53/591, 148, 594; 221/201, 202, 205, 251

[56] References Cited

U.S. PATENT DOCUMENTS

| | | | |
|---|---|---|---|
| 466,928 | 1/1892 | Graves | 221/202 |
| 1,281,870 | 10/1918 | Strand | 221/205 X |
| 1,825,058 | 9/1931 | Goldstein et al. | 221/201 X |
| 1,916,974 | 7/1933 | Fuller et al. | 221/202 X |
| 2,429,510 | 10/1947 | Callison | 221/205 X |
| 2,503,518 | 4/1950 | Slaughter | 53/560 X |
| 3,458,086 | 7/1969 | Strohmeier | 221/201 |
| 3,713,563 | 1/1973 | Dickensheets et al. | 221/205 |
| 3,729,885 | 5/1973 | Mosetich et al. | 53/591 X |

*Primary Examiner*—Horace M. Culver

[57] ABSTRACT

A process and relevant machine and has for its object to provide a means for packing individual drinking straws, or similarly shaped articles, in sealed strips consisting of two "films" which can be either hot or cold welded. The stages of said process are as follows:

(a) formation of a compact line of straws arranged and cross fed along an inclined plane onto which they are released from a hopper where they are stacked;

(b) removal of the first straw from the aforesaid line with the simultaneous arrest of the second one;

(c) conduction of each straw into cut-outs provided in welding rollers.

11 Claims, 1 Drawing Figure

Figure 1:
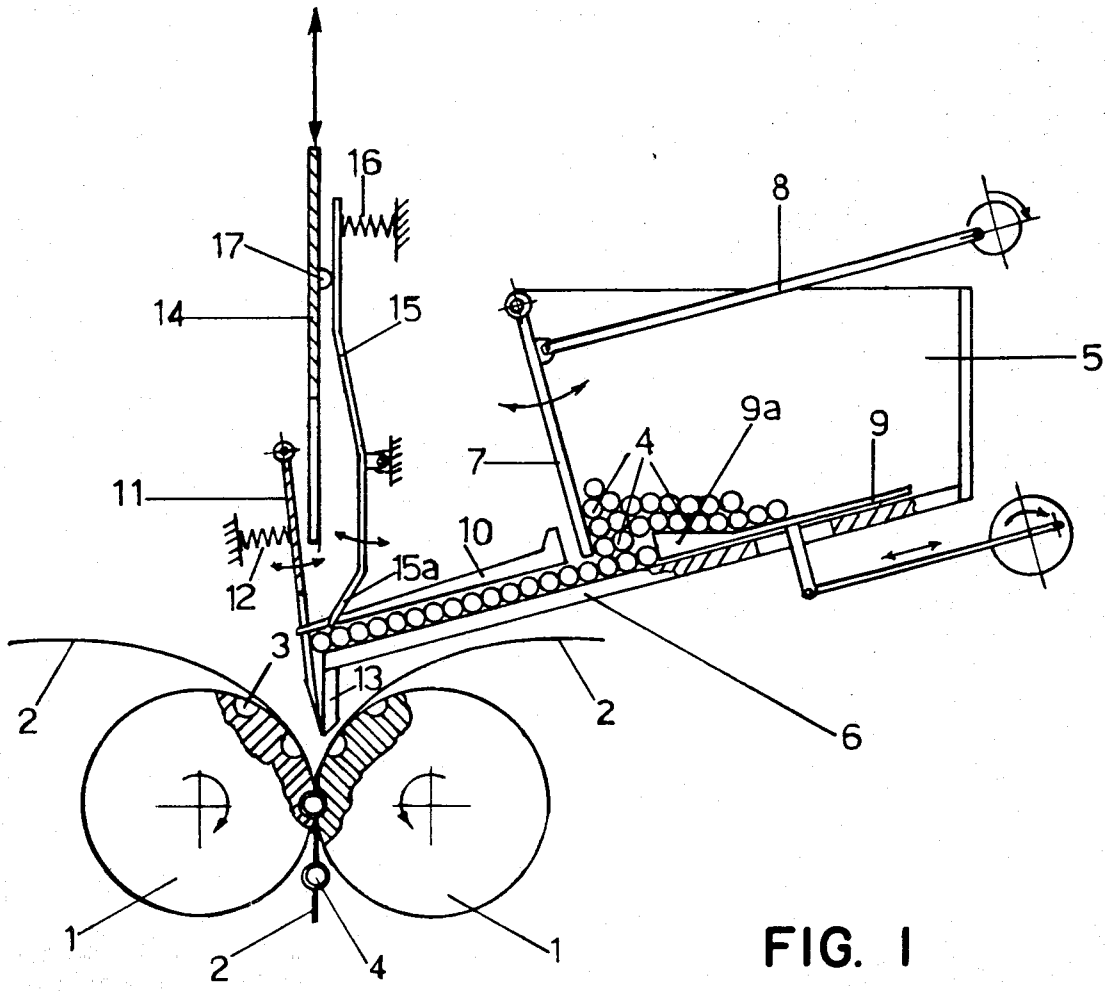

PROCESS AND MACHINE FOR AUTOMATICALLY PACKING INDIVIDUAL DRINKING STRAWS, OR SIMILARLY SHAPED ARTICLES, IN WELDABLE FILMS

This invention relates to a process and relevant machine and has for its object to provide a means for packing individual drinking straws, or similarly shaped articles, in sealed strips consisting of two "films" which can be either hot or cold welded, (the term "film" is used to indicate a film of weldable laminate material).

The need for said packing process derives from the ever increasing trend of distributing soft drinks, mineral water and other drinks in general, in carton packs to which, above all in the case of milk and soft drinks, a drinking straw has been externally applied. Moreover these straws must be suitably wrapped for reasons of hygiene.

The application of said straws to each container is carried out automatically by special machines which require the straws to be individually packed in continuous strips from which one straw at a time may be removed by a series of transversal cuts for application to the aforesaid cartons.

It is clear that for the operation of these automatic machines there must be constant parallelism and equidistance between all the straws enclosed in the strips in order to avoid the straws being damaged when the strip is cut, which would result in the jamming and interruption of the working process.

The need for constant parallelism and equidistance between the straws is met by using strips whereby the straws are inserted and blocked between two "films," transparent or opaque according to preference, which can be either hot or cold welded around the individual straw.

Packing of other products into pockets obtanined from two "films" welded together is common practice but in the case in question new particulars and problems have arisen on account of the following specific requirements:

(a) the isolation and removal of a single straw from the hopper;

(b) the presence of unexpected forces of attraction and repulsion between the straws due to the static electricity they can easily generate since they are made of plastic;

(c) the welding of the "films" as near as possible to each straw to ensure the maximum immobility of same inside the strip.

These and other difficulties have been overcome with the process and machine described herein the operational stages of which are as follows:

formation of a crosswise line of straws released from a hopper where they are stacked;

removal of one straw at a time from the aforementioned line;

conduction of each straw into the cut-outs provided in the welding rollers.

This invention relates to the automatic packing of straws in strips by a machine comprising:

two welding rollers, tangent along a generatrix, with superficial longitudinal cut-outs which meet during rotation of said rollers;

means for removing, pushing and conducting each straw until inside aforesaid cut-outs;

means for the formation of a line of straws which are cross fed and released from a hopper where stacked;

means to give the line of straws an intermittent motion of translation towards the point where the straws are cyclically removed one at a time.

With reference to the accompanying drawing which illustrates only one embodiment of this invention and where FIG. 1 is a schematic side view of the machine, partly in section, with a vertical longitudinal plane, the following description will clearly disclose further characteristics and advantages of said invention.

Referring to FIG. 1 the machine for automatically packing straws in strips consists of two welding rollers (1), tangent along a generatrix, between which run two "films" (2), wound off of two opposed reels.

The presence of longitudinal cut-outs (3), in a regular formation on the external surface of both the rollers (1), allows for the formation of a strip characterised by a series of close transversal pockets, parallel and equidistant, inside which a straw must obviously have been inserted.

The straws (4) are stacked inside a hopper (5), the width of which is equal to the length of the straws.

The bottom (6) of said hopper consists of an inclined plane which protrudes beyond the hopper and finishes at a distance equal to the radius of a straw from the vertical plane which contains the generatrix for contact between the welding rollers (1) situated beneath the chute defined by the inclined plane (6).

The front wall (7) of the hopper is hinged at the top between the two side walls, and is held by a connecting rod (8) which wall 7 is almost at a right angle to the inclined plane (6) and is raised to a height which is slightly more than the diameter of a straw.

Moreover, on the bottom of the hopper is a thin platform (9) with a raised front edge (9*a*), with an alternating longitudinal motion which pushes the straws out of the hopper and ensures the formation of a tight and compact line of straws.

The alternating reciprocal runs of the platform (9) together with the oscillating movement of the wall (7) avoids any possibility of accumulation occurring and blocking of the straws against the wall (7) itself.

At the bottom of said wall is a compact line of straws (4) which move along the inclined plane (6) and under two longitudinal arms (10). Said arms are fixed and parallel to the chute (6) and terminate beyond the stopping rod (11) found in front of the bottom corner edge of the inclined plane.

This stopping rod (11) is transversally hinged along its upper edge; its lower edge is pushed by a spring (12), against the lower edge of a rigid "flap" (13) which protrudes vertically from under the bottom corner edge of the chute (6) in the proximity of the welding rollers (1) found underneath.

The distance between the aforesaid bottom corner edge and the surface of the opposing stopping rod (11) is slightly less than the diameter of a straw, thus each straw, once it has slid down the chute is stopped and held at the top of a discharge tube, by converging planes 11, 13, which terminates a little above the welding rollers (1).

In order that the arms (10) may extend beyond the vertical plane containing the generatrix for contact between the rollers (1), the aforementioned stopping rod is provided with a deep, wide, central, "U" shaped notch along its lower edge.

Each straw is pushed downwards between the rod (11) and the "flap" (13) by a guillotine (14) found on the vertical plane containing the generator for contact between the welding rollers (1) and situated above the lowermost corner of the inclined plane (6).

To avoid interference with the arms (10) during their alternating runs, the guillotine (14) is provided with a central "U" shaped notch along its lower edge.

The machine, according to this invention, also foresees the use of a forked lever (15) which ends in two feet (15*a*), which worked by a spring (16) acting on the lever (15) exert the required pressure on the second straw in the line in order to withold it slightly, whilst the first straw is being fed by the guillotine (14) and pushed between the two rollers (1).

The actioning of said lever 15 occurs by means of a ridge (17) situated on the guillotine (14).

Having now considered the structure of the machine according to this invention the packing stages of each straw shall herewith be described in more detail.

It is assumed that the first straw in the line which is moving forwards along the chute (6) reaches the stopping rod (11), and is therefore suspended between said stopping rod and the front corner of the inclined plane (6).

During the downard run of the guillotine (14), the ridge (17) slides against the lever (15), which is shaped in such a way that the restraining action of the ridge is eliminated thus enabling the feet (15*a*), which are uplifted, to be actioned by the spring (16) and to push lightly on the second straw in the line, which at that moment is still on the inclined plane (6), near the bottom corner, close to the first straw.

The guillotine (14), on its downward run, moves the stopping rod (11) away from the "flap" (13), in such a way that the straw (4) can gradually descend between the stopping rod (11) and the "flap" (13), pushed by the guillotine (14), which conducts it into the cut-outs (3) of the welding rollers (1), after having passed the lower edges of the stopping rod (11) and the "flap" (13).

The guillotine (14) moves down towards the cut-outs (3) to ensure the exact positioning of the straw in the cut-outs, from which, otherwise, the straw would be expelled by the two close and tight "films" (2).

The description herein presented refers to a preferred arrangement of the machine according to the said invention but omitting construction particulars as it is assumed that these should be clear and feasible to any expert in this field.

Therefore numerous variations and modifications above all regarding the construction may be carried out on said machine without going beyond the scope of the invention herein described and illustrated.

Moreover it is evident that as already indicated the process and machine specified herein, with suitable and simple variations, may be used to pack not only straws but also similarly shaped articles, for example pencils, pens, toothpicks etcetera.

I claim:

1. A device for packing a plurality of elongate articles of uniform shape between two films of packaging material such that the distance between adjacent articles when packaged is constant and the two films between said adjacent articles are laminated together comprising in combination:

a storage hopper containing a plurality of the articles to be packaged, means for dispensing the articles from said hopper in an array such that the articles are linearly aligned in a series, means for feeding the articles one at a time from the series for packaging, a packaging means including the two films which receive each article at a site of tangency of the two films, whereby downstream from said receiving site the two films are laminated together and an accomodation pocket will have been provided for each article equispaced from adjacent fed articles, the films laminated providing equispaced intervals for subsequent severing;

wherein said storage hopper comprises an open top receptacle having a bottom wall formed as an inclined plane;

wherein said means for dispensing the articles from said hopper include a platform disposed within the hopper provided with means for oscillating said platform, said platform spaced from and parallel with said inclined bottom wall and said oscillating means moves said platform in an oscillatory motion parallel to said inclined bottom wall;

wherein said platform includes a raised front edge which encourages the articles to accumulate at a lowermost portion of the hopper;

wherein said hopper and said means for dispensing the articles include a wall under which the articles pass, said wall provided with a hinge at its topmost portion and a connecting rod extending from said wall to a means for oscillating said wall in an arcuate manner about said hinge so as to encourage one article to be dispensed at a time;

wherein said means for dispensing further includes at least one longitudinal arm overlying the articles having been dispensed from said hopper, said articles disposed on a continuation of said bottom wall defining a chute, said longitudinal arm constraining the articles to remain in an array linearly aligned in a series; and wherein said feeding means includes a stopping rod disposed adjacent a lowermost edge of said inclined plane, a hinge transversely disposed along a top edge of said stopping rod and means pivoting said stopping rod in an arcuate fashion about said hinge to thereby provide a passageway for the articles.

2. The device of claim 1 including a flap depending downwardly from said lowermost edge of said inclined plane cooperating with said stopping rod to serve as a guide to feed the articles when said stopping rod is rotated in an arcuate fashion providing the passageway.

3. The device of claim 2 including a guillotine type feeding instrumentality adapted for vertical motion between said stopping rod and said flap to encourage the articles to pass between said stopping rod and said flap.

4. The device of claim 3 wherein said stopping rod is biased to act against the motion of said guillotine.

5. The device of claim 4 including a lever oriented to engage an article immediately adjacent the article being fed and retain same, said lever adapted to index with said guillotine, whereby the adjacent article will be fed after the previous article has been dispensed between said stopping rod and said flap.

6. The device of claim 5 wherein said lever includes biasing means to work against said guillotine.

7. The device of claim 6 wherein said lever includes a cam surface adapted to co-act against a ridge disposed on said guillotine and opposed by said biasing means.

8. The device of claim 7 wherein said packaging means includes first and second rollers provided with a plurality of cut-outs dimensioned to receive the article, said respective cut-outs being placed in registry with one another and each cut-out being substantially half the dimension of the article, whereby when said cut-outs of each said roller are in registry, the entire article can be accommodated therebetween, and wherein the films fed to each said roller overly each said roller, whereby when the article is placed within said cut-outs, the film overlaps the article and a pocket accommodating the article is thereby formed.

9. The device of claim 8 wherein spaces are provided between adjacent cut-outs on each said roller so as to define the area at which the films are laminated together.

10. The device of claim 9 wherein said oscillating means includes a cam attached to an oscillating rod.

11. The device of claim 10 wherein the articles are embodied as straws having constant cross-section along the entire longitudinal extent.

* * * * *